US009281564B2

(12) United States Patent
Vincent

(10) Patent No.: US 9,281,564 B2
(45) Date of Patent: Mar. 8, 2016

(54) SYSTEMS AND METHODS FOR PROVIDING DIRECTIONAL RADIATION FIELDS USING DISTRIBUTED LOADED MONOPOLE ANTENNAS

(75) Inventor: Robert J. Vincent, Warwick, RI (US)

(73) Assignee: University of Rhode Island Research Foundation, Kingston, RI (US)

( * ) Notice: Subject to any disclaimer, the term of this patent is extended or adjusted under 35 U.S.C. 154(b) by 134 days.

(21) Appl. No.: 12/871,239

(22) Filed: Aug. 30, 2010

(65) Prior Publication Data

US 2011/0210900 A1 Sep. 1, 2011

Related U.S. Application Data

(63) Continuation of application No. PCT/US2009/036151, filed on Mar. 5, 2009.

(60) Provisional application No. 61/033,953, filed on Mar. 5, 2008.

(51) Int. Cl.

| | |
|---|---|
| ***H01Q 21/00*** | (2006.01) |
| ***H01Q 9/16*** | (2006.01) |
| ***H01Q 11/00*** | (2006.01) |
| ***H01Q 7/00*** | (2006.01) |
| ***H01Q 9/30*** | (2006.01) |
| ***H01Q 11/14*** | (2006.01) |

(52) U.S. Cl.

CPC . *H01Q 9/16* (2013.01); *H01Q 7/00* (2013.01); *H01Q 9/30* (2013.01); *H01Q 11/14* (2013.01); *Y10T 29/49004* (2015.01); *Y10T 29/49016* (2015.01)

(58) Field of Classification Search

CPC ..... H01Q 11/14; H01Q 9/16
USPC ..... 343/793, 893, 867
See application file for complete search history.

(56) References Cited

U.S. PATENT DOCUMENTS

| | | | | |
|---|---|---|---|---|
| 3,518,692 | A * | 6/1970 | Kuecken | 343/797 |
| 5,479,176 | A * | 12/1995 | Zavrel, Jr. | 342/374 |
| 6,861,981 | B2 | 3/2005 | Park et al. | |
| 6,987,493 | B2 * | 1/2006 | Chen | 343/893 |
| 7,187,335 | B2 | 3/2007 | Vincent | |
| 2004/0140862 | A1 | 7/2004 | Brown et al. | |
| 2005/0273218 | A1 * | 12/2005 | Breed et al. | 701/2 |
| 2006/0022883 | A1 * | 2/2006 | Vincent | 343/722 |
| 2006/0025897 | A1 | 2/2006 | Shostak et al. | |
| 2007/0159315 | A1 | 7/2007 | Murata et al. | |

OTHER PUBLICATIONS

Dossche, S.; Blanch, S.; Romeu, J., "Decorrelation of a closely spaced four element antenna array," Antennas and Propagation Society International Symposium, 2005 IEEE , vol. 1 B, No., pp. 803,806 vol. 1B.*

(Continued)

*Primary Examiner* — Sue A Purvis
*Assistant Examiner* — Amal Patel
(74) *Attorney, Agent, or Firm* — Gesmer Updegrove LLP

(57) ABSTRACT

An antenna system is disclosed that provides a directional radiation field. The antenna system includes at least two monopole antennas, each of which provides a differential connector. Each differential connector is associated with a signal having a different phase such that a radiation field associated with said antenna system is other than a radiation field that would exist if each differential connector were associated with the signal having the same phase.

8 Claims, 17 Drawing Sheets

(56) References Cited

OTHER PUBLICATIONS

Haynes, A Primer on Digital Beamforming, Spectrum Signal Processing, pp. 1-15, spectrumsignal.com, USA, Mar. 26, 1998.
Evaluation Board for the AD8333 I/Q Demodulator. AD8333-EVAL, Analog Devices, Norwood, MA, 10 pages.
Analog Devices Corporation, DC to 50 MHz Dual I/Q Demodulator and Phase Shifter, AD8333 Data Sheet, http://www.analog.com/en/prod/0,,770_849_AD8333,00.html, 3 pages.
AD8333 DC to 50 MHz, Dual I/Q Demodulator and Phase Shifter Product Description, "Analog Devices Technology Simplifies medical Ultrasound Design", http: findarticles.com/p/articles/mi_m0EIN/is_2005_April_25/ai_n13650847, Feb. 12, 2008, 3 pages.
Spatial Spectrum Analysis With Low Sample Support Via Adaptive Beamforming, Masters Thesis of Yifan Liang, Purdue University, Aug. 2004, 88 pages.
Sun et al., Fast Beamforming of Electronically Steerable Parasitic Array Radiator Antennas: Theory and Experiement, IEEE Transactions on Antennas and Propagation, pp. 1819-1832, vol. 52, No. 7, IEEE, USA, Jul. 2004.
Ready et al., System Architectures for Narrowband Reconnaissance Receivers and Beamforming Applications, DSP & Multimedia Technology, pp. 1-6, Applied Signal Technology, Inc., USA, May/Jun. 1998.
Converse et al., Ultrawide-Band Microwave Space-Time beamforming for Hyperthermia Treatment of Breast Cancer: A Computational Feasibility Study, IEEE Transactions on Microwave Theory and Techniques, pp. 1876-1889, vol. 52 No. 8, IEEE, USA, Aug. 2004.
Montebugnolli et al., "Some Notes on Beamforming" The Medicina IRA-SKA Engineering Group, IRA N. 353/04, 11 pages.
International Preliminary Report on Patentability issued on Sep. 7, 2010 in connection with International Application No. PCT/US2009/036151, 7 pages.
International Search Report and Written Opinion issued on Apr. 22, 2009 in connection with International Application No. PCT/US2009/036151, 10 pages.

* cited by examiner

SYSTEMS AND METHODS FOR PROVIDING DIRECTIONAL RADIATION FIELDS USING DISTRIBUTED LOADED MONOPOLE ANTENNAS

PRIORITY

This application is a continuation application of PCT/US2009/036151 filed on Mar. 5, 2009, which claims priority to U.S. Provisional Patent Application Ser. No. 61/033,953 filed Mar. 5, 2008, the entire disclosure of which is hereby incorporated by reference.

BACKGROUND

The present invention generally relates to antennas, and relates in particular to antenna systems that provide adjustment of reception and transmission field shapes associated with the antenna systems.

Monopole antennas typically include a single pole that may include additional elements with the pole. Non-monopole antennas generally include antenna structures that form two or three dimensional shapes such as diamonds, squares, circles etc. Monopole antennas typically produce a transmission field (and are characterized as having a reception field) that radiates in two adjacent generally circular or eliptospherical shapes that are joined at the antenna.

Multiple antenna structures produce a wide variety of transmission fields (and corresponding reception fields) according to the physical layout of the antennas and/or transmission signal phase modulations placed on signals that are directed to or received by each of the antennas in an antenna structure. For example, as disclosed in "*A Primer on Digital Bean forming*" by Toby Haynes, http://www.spectrumsignal-.com, Spectral Signal Processing, Mar. 26, 1998, beam shaping antenna structures may be provided by positioning adjacent monopole antennas a distance apart of about ½λ in a linear direction wherein the wavelength is the center wavelength of the signal being either transmitted or received. Beam shaping may also be provided by using a plurality of monopole antennas that are fed electronically through a phase multiplexer and are also each about ½λ apart. As further disclosed in this reference, however, certain wireless transmission systems, such as cellular telephones, operate at a wavelength of 35 cm, while FM radio operates at a wavelength of 3 meters and AM radio operates at a wavelength of 300 meters. Providing beam shaping for such wireless systems clearly requires a not insubstantial antenna area or integrated circuit real estate.

Beam shaping in such wireless transmission systems may have significant value in myriad applications. For example, shaping radio frequency interrogation beams in medical imaging systems, such as magnetic resonance imaging (MRI) systems, may be very beneficial to providing more targeted interrogation MRI fields within a patient, and in other applications, such systems may have a wide variety of applications in monitoring devices such as, for example, tire monitoring devices in automobiles. U.S. Patent Application Publication No. 2007/0159315, for example, discloses a tire pressure monitoring system that employs a fixed antenna array to detect signals from each of four tires using shaped beams.

As wireless communication systems become more ubiquitous, the need for smaller and more efficient antennas systems increases, and in particular for antenna system that provide beam shaping without requiring a large amount of antenna volume or integrated circuit real estate.

There is a need, therefore, for more efficient and cost effective implementation of a antenna systems that provide selectively highly directional beam shaping.

SUMMARY

In accordance with an embodiment, the invention relates to an antenna system that provides a directional radiation field. The antenna system includes at least two monopole antennas, each of which provides a differential connector, wherein each differential connector is associated with a signal having a different phase such that a radiation field associated with the antenna system is other than a radiation field that would exist if each differential connector were associated with the signal having the same phase.

In accordance with a further embodiment, the antenna system includes at least two distributed load monopole antennas each of which includes a radiation resistance unit coupled to a transmitter base, a current enhancing unit for enhancing current through the radiation resistance unit; and a conductive mid-section intermediate the radiation resistance unit and the current enhancing unit. The conductive mid-section has a length that provides that a sufficient average current is provided over the length of the antenna. Each of the two distributed load monopole antennas is coupled to a connector, and at least one connector is coupled to a phase changing device such that the directional radiation field is provided by the antenna system responsive to the phase changing device.

In accordance with a further embodiment, the invention relates to a method of providing a directional radiation field in an antenna system. The method includes the steps of providing at least two monopole antennas; coupling at least one of the monopole antennas to a phase modulation device; and operating the antenna system such that each monopole antenna operates at a different phase to provide the directional radiation field.

BRIEF DESCRIPTION OF THE DRAWINGS

The following description may be further understood with reference to the accompanying drawings in which.

The drawings are shown for illustrative purposes only.

DETAILED DESCRIPTION OF THE ILLUSTRATED EMBODIMENTS

It has been discovered that multiple antenna systems may be provided that achieve beam shaping without requiring that the antennas be positioned at least ½λ apart. Such multiple antenna systems may be provided by employing a plurality of distributed loaded monopole (DLM) antennas as disclosed, for example, in U.S. Pat. No. 7,187,335, the disclosure of which is hereby incorporated by reference.

Figure 1A:
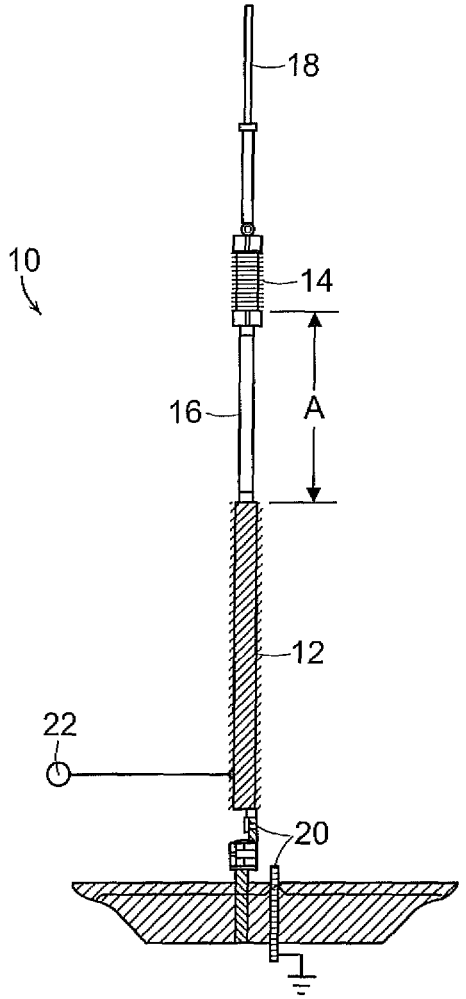
FIG. 1A PRIOR ART
FIGS. 1A and 1B show diagrammatic illustrative views of distributed loaded monopole antennas of the prior art.

In particular, FIG. 1A shows a DLM antenna 10 that includes a radiation resistance unit 12 and a current enhancing unit 14 that are separated by a mid-section 16. A top section 18 extends from the top of the current enhancing unit 14. The radiation resistance unit may be comprised of a helical winding (as shown in FIG. 1A) or a coil winding of a wide variety of types as further disclosed in U.S. Pat. No. 7,187,335. The current enhancing unit may also be formed of a load coil as shown or a coil winding of a wide variety of types as further disclosed in U.S. Pat. No. 7,187,335. The base of the radiation resistance unit 12 is coupled to ground as shown at 20, and a signal is applied to (or received from) the antenna via connector 22 that couples to a selected point on the radiation resistance unit 12 as shown.

The radiation resistance unit may, for example, be separated from the current enhancing unit by a distance of $2.5316\times10^{-2}\lambda$ of the operating frequency of the antenna to provide a desired current distribution over the length of the antenna. The choice of the distance A of the load coil above the helix impacts the average current distribution along the length of the antenna. The average current distribution over the length of the antenna varies as a function of the mid-section distance for a 7 MHz distributed loaded monopole antenna. The conductive mid-section has a length that provides that a sufficient average current is provided over the length of the antenna and provides for increasing radiation resistance to that of 2 to nearly 3 times greater than a ½λ antenna (i.e., from for example, 36.5 Ohms to about 72-100 Ohms or more).

The inductance of the load coil should be larger than the inductance of the helix. In addition to providing an improvement in radiation efficiency of a helix and the antenna as a whole, placing the load coil above the helix for any given location improves the bandwidth of the antenna as well as the radiation current profile. The helix and load coil combination are responsible for decreasing the size of the antenna while improving the efficiency and bandwidth of the overall antenna.

Figure 1B:
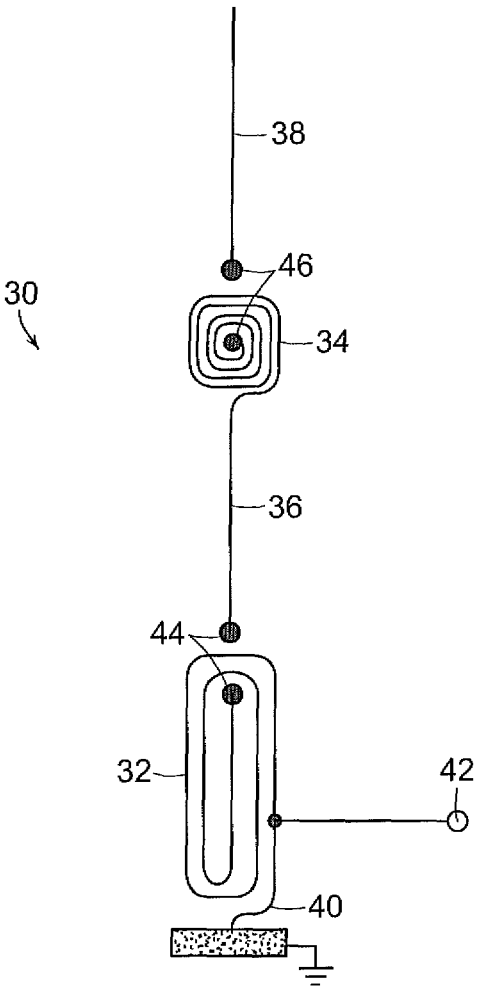
FIG. 1B PRIOR ART

FIG. 1B shows a plan-spiral DLM antenna 30 that includes coils fabricated in two planes. The DLM antenna 30 includes a radiation resistance unit 32 and a current enhancing unit 34 that are separated by a mid-section 36. A top section 38 extends from the top of the current enhancing unit 34. The base of the radiation resistance unit 32 is coupled to ground as shown at 40, and a signal is applied to (or received from) the antenna via connector 42 that couples to a selected point on the radiation resistance unit 32 as shown. Such an antenna may be provided on a printed circuit board by including continuous conductive via connectors shown at 44 and 46 as is well known in the art. The antenna 30 may be scaled to provide operation at ultra high frequencies and microwave radio frequencies. The coil 32 may also include a plurality of tap points for coupling the connector 42 at a variety of locations on the radiation resistance unit 32. The connector 22 of FIG. 1A and connector 42 of FIG. 1B may each be provided as a coaxial connector (e.g., 50 ohms) with the outer conductor coupled to ground as shown.

Figure 2:
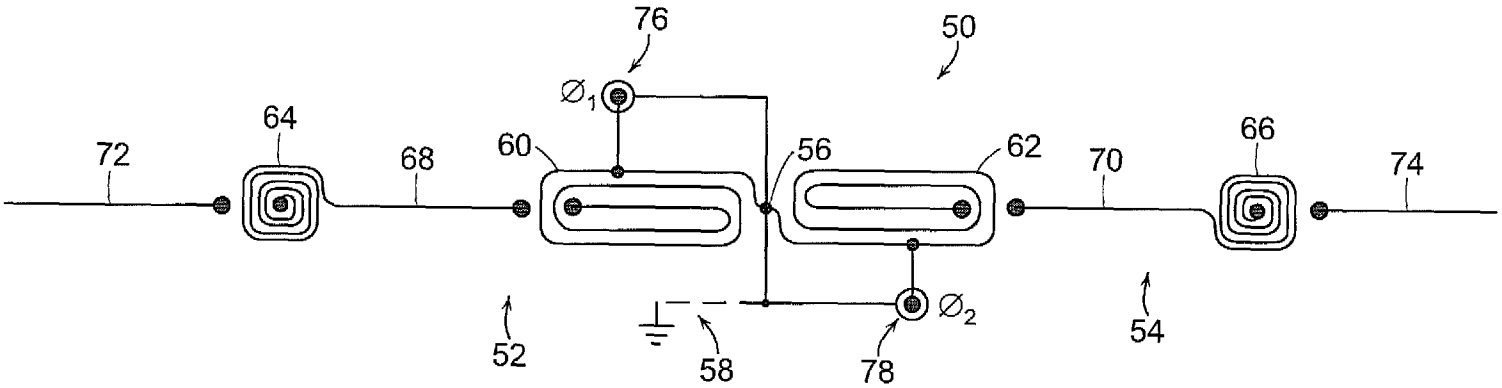
FIG. 2 shows an illustrative diagrammatic view of a beam shaping system in accordance with an embodiment of the invention employing a distributed load dipole antenna.

As stated above, applicant has discovered that multiple antenna systems may be provided that achieve beam shaping without requiring that the antennas be positioned at least ½λ apart. For example, FIG. 2 shows at 50 a plano-spiral distributed load dipole antenna system that is formed from two plano-spiral distributed load monopole antennas 52, 54 that are coupled together at their bases 66, and the common bases may optionally be coupled to ground as shown at 58. Each distributed load monopole antenna 52, 54 includes a radiation resistance unit 60, 62, and a current enhancing unit 64, 66 that are separated by a conductive mid-section 68, 70 respectively as shown, as well as top sections 72, 74. Each monopole antenna includes a differential connector such as a 50Ω coaxial feed (76, 78 respectively) that is coupled with one lead to a coupling point on a respective radiation resistance unit (60, 62 respectively), and include a second (typically ground) lead that is coupled to the common base.

Because the antenna system 50 includes two differential inputs, the signal being either transmitted or received may be shaped by providing that one or both of the differential inputs is phase shifted with respect to the other. For example, the signal associated with the connector 76 may be at a first phase $\phi_1$ and first amplitude while the signal associated with the connector 78 is at a second phase $\phi_2$ and second amplitude. The antenna system may be fed from one antenna or the other antenna or from both antennas. The common base may be coupled to ground or may float at a virtual ground, or may be held another potential.

Figure 3:
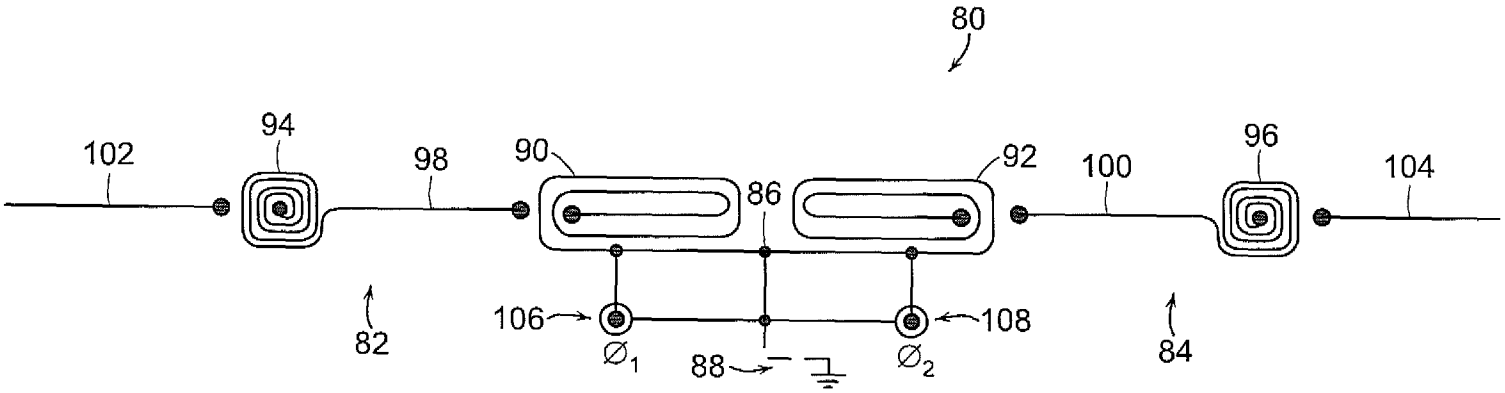
FIG. 3 shows an illustrative diagrammatic view of a beam shaping system in accordance with another embodiment of the invention employing a distributed load dipole antenna with one monopole antenna transposed.

FIG. 3 shows at 80 another plano-spiral distributed load dipole antenna system that is formed from two plano-spiral distributed load monopole antennas 82; 84 that are coupled together at their bases 86 but the radiation resistance units are not transposed with respect to each other. The common bases may optionally be coupled to ground as shown at 88. Each distributed load monopole antenna 82, 84 includes a radiation resistance unit 90, 92, and a current enhancing unit 94, 96 that are separated by a conductive mid-section 98, 100 respectively as shown, as well as top sections 102, 104. Each monopole antenna includes a differential connector such as a 50Ω coaxial feed (106, 108 respectively) that is coupled with one lead to a coupling point on a respective radiation resistance unit (90, 92 respectively), and include a second (typically ground) lead that is coupled to the common base. The signal associated with the connector 106 may be at a first phase $\phi_1$ and first amplitude while the signal associated with the connector 108 is at a second phase $\phi_2$ and second amplitude.

Figure 4:
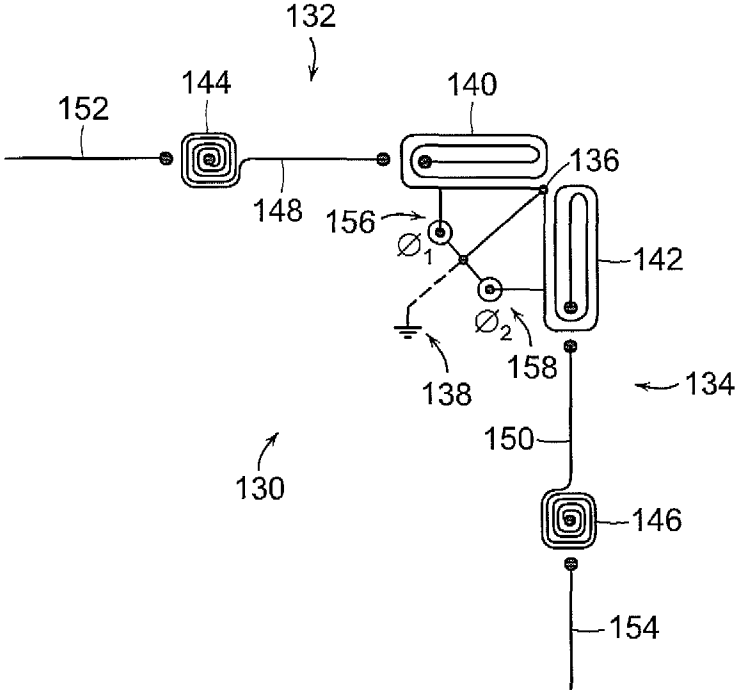
FIG. 4 shows an illustrative diagrammatic view of a beam shaping system in accordance with another embodiment of the invention employing a folded distributed load dipole antenna.

In each of the distributed load dipole antenna systems 50 and 80, the radiation field may be shaped by changing the difference between the phases ($\phi_1-\phi_2$). The physical layout of the monopole antennas may also be changed. For example, FIG. 4 shows at 130 another plano-spiral distributed load dipole antenna system that is formed from two plano-spiral distributed load monopole antennas 132, 134 that are coupled together at their bases 136, and the common bases may optionally be coupled to ground as shown at 138. Each distributed load monopole antenna 132, 134 includes a radiation resistance unit 140, 142, and a current enhancing unit 144, 146 that are separated by a conductive mid-section 148, 150 respectively as shown, as well as top sections 152, 154. Each monopole antenna includes a differential connector such as a 50Ω coaxial feed (156, 158 respectively) that is coupled with one lead to a coupling point on a respective radiation resistance unit (140, 142 respectively), and include a second (typically ground) lead that is coupled to the common base. The signal associated with the connector 156 may be at a first phase $\phi_1$ and first amplitude while the signal associated with the connector 158 is at a second phase $\phi_2$ and second amplitude.

Figure 5:
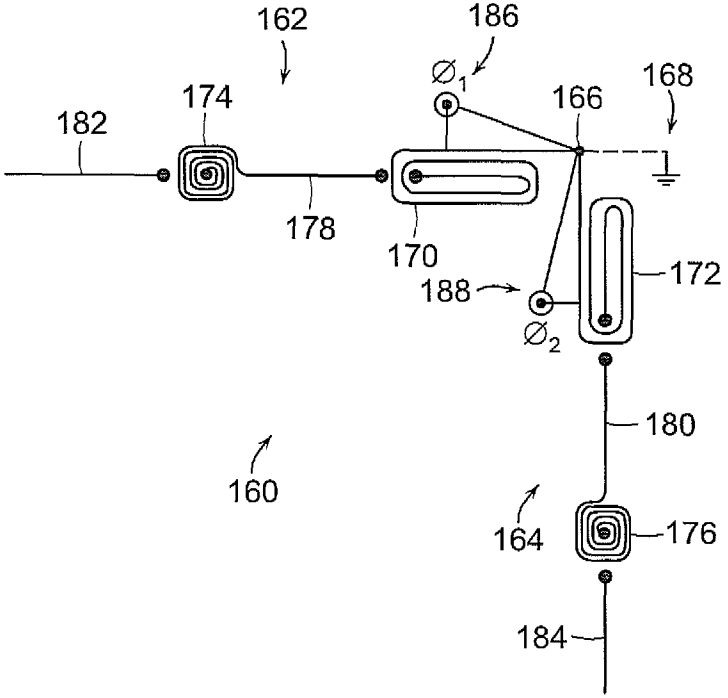
FIG. 5 shows an illustrative diagrammatic view of a beam shaping system in accordance with another embodiment of the invention employing a folded distributed load dipole antenna with one monopole antenna transposed.

FIG. 5 shows at 160 another plano-spiral distributed load dipole antenna system that is formed from two plano-spiral distributed load monopole antennas 162, 164 that are coupled together at their bases 166 but the radiation resistance units are not transposed with respect to each other. The common bases may optionally be coupled to ground as shown at 168. Each distributed load monopole antenna 162, 164 includes a radiation resistance unit 170, 172, and a current enhancing unit 174, 176 that are separated by a conductive mid-section 178, 180 respectively as shown, as well as top sections 182, 184. Each monopole antenna includes a differential connector such as a 50Ω coaxial feed (186, 188 respectively) that is coupled with one lead to a coupling point on a respective radiation resistance unit (170, 172 respectively), and include a second (typically ground) lead that is coupled to the common base. The signal associated with the connector 186 may be at a first phase $\phi_1$ and first amplitude while the signal associated with the connector 188 is at a second phase $\phi_2$ and second amplitude. The amplitude of one signal with respect to the other may also be adjusted to provide further beam shaping characteristics.

By employing combinations of such distributed load monopole antennas in various structural combinations in dipole systems and by using signals have a phase difference, a wide variety of radiation field shapes may be provided for transmission, reception or both transmission and reception. Because each monopole antenna in the antenna system includes a separate differential connector (for either transmission or reception), the phase of each may be changed to provide a desired beam shape, and there is no need to physically separate each antenna from one another by a distance of at least ½λ. Each of the above antenna systems may be readily scaled in size to accommodate signal frequencies from less than 1 MHz to over 1000 MHz (e.g., 75 MHz may be employed), and although the above antenna systems use plano-spiral circuit antennas such as shown in FIG. 1B, the above antenna systems may also be provided using non-planar three-dimensional antennas such as shown in FIG. 1A. Performance and bandwidth may improve with higher frequencies.

Figure 6:
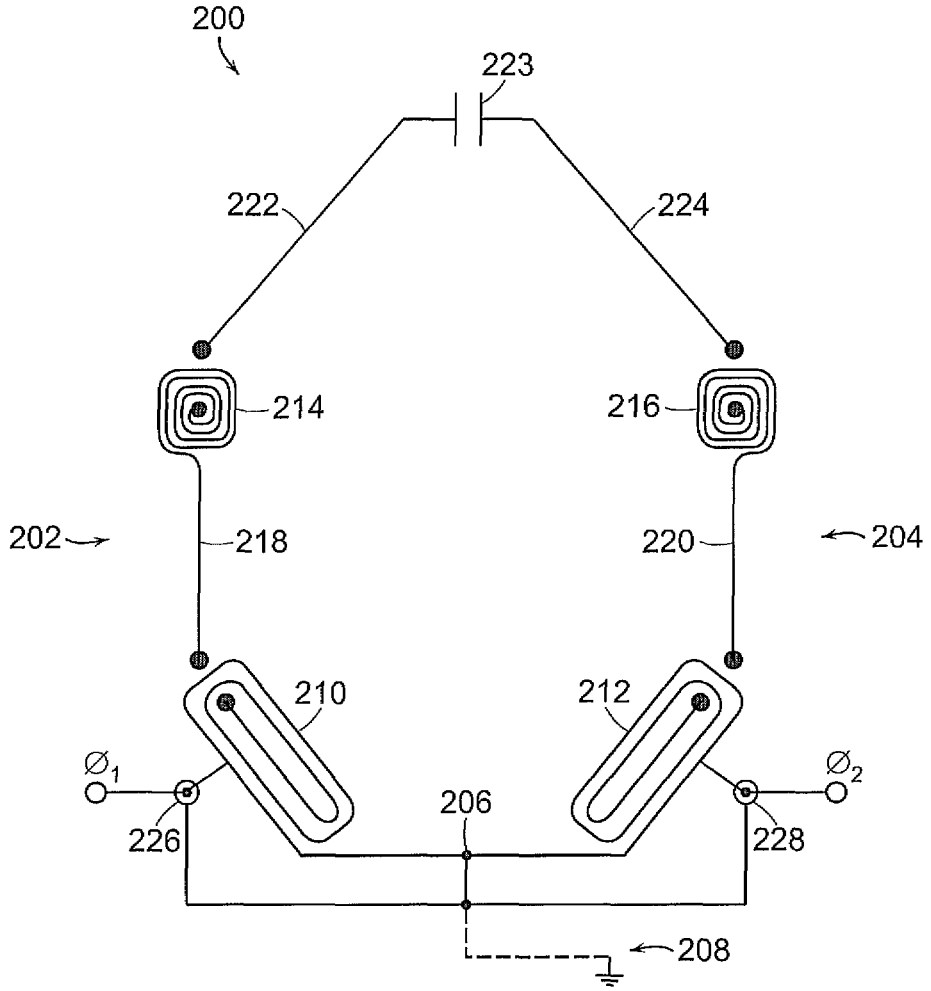
FIG. 6 shows an illustrative diagrammatic view of a half-loop antenna system in accordance with an embodiment of the invention.

FIG. 6 shows a further antenna system 200 in accordance with an embodiment of the invention that is formed from two plano-spiral distributed load monopole antennas 202, 204 that are coupled together at their bases 206, and the common bases may optionally be coupled to ground as shown at 20. The antennas form a half-loop antenna system. Each distributed load monopole antenna 202, 204 includes a radiation resistance unit 210, 212, and a current enhancing unit 214, 216 that are separated by a conductive mid-section 218, 220 respectively as shown, as well as top sections 222, 224. The tops of each top section are joined by a tuning capacitor 223. Each monopole antenna includes a differential connector such as a 50Ω coaxial feed (226, 228 respectively) that is coupled with one lead to a coupling point on a respective radiation resistance unit (210, 212 respectively), and include a second (typically ground) lead that is coupled to the common base. The signal associated with the connector 226 may be at a first phase $\phi_1$ and amplitude while the signal associated with the connector 228 is at a second phase $\phi_2$ and second amplitude.

Figure 7:
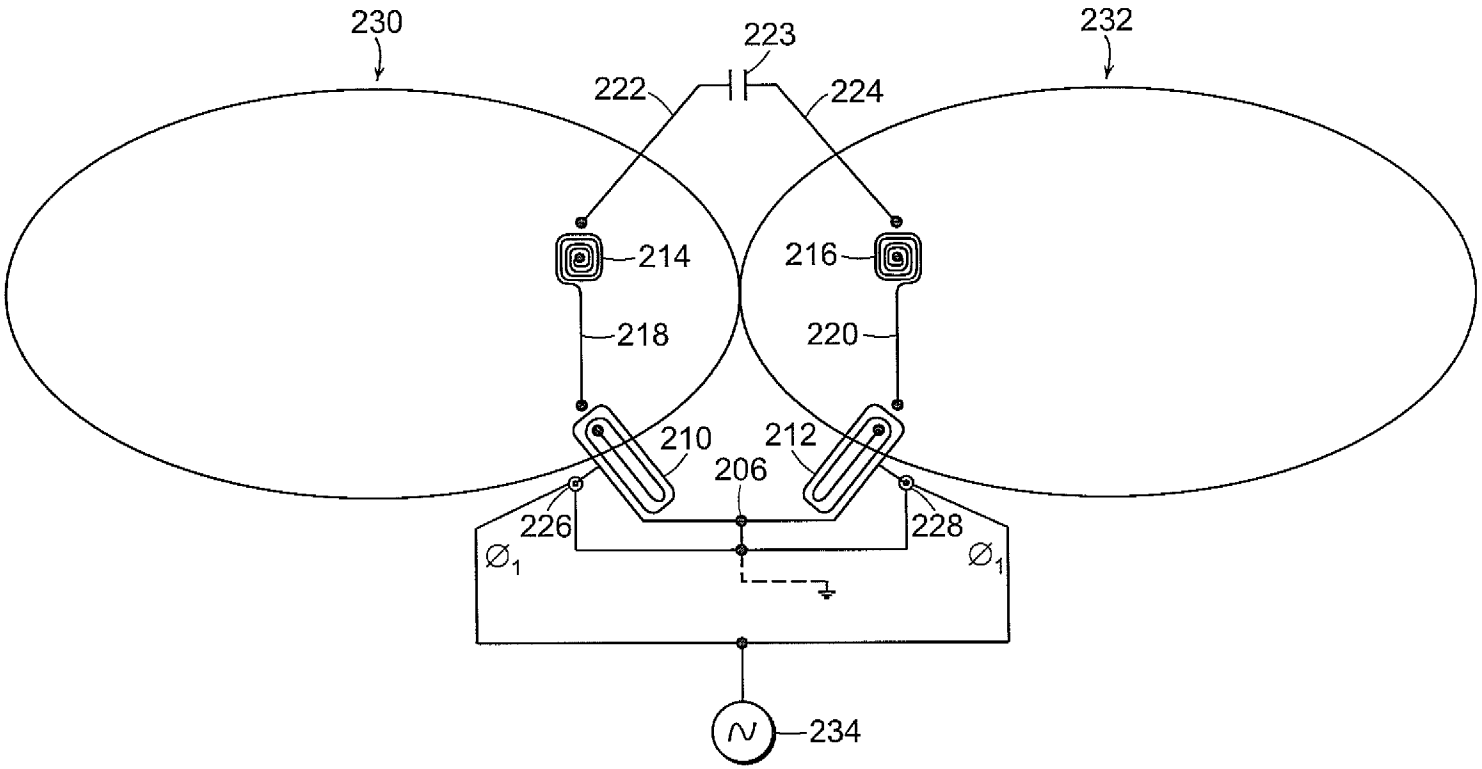
FIG. 7 shows an illustrative diagrammatic view of the antenna system of FIG. 6 with radiation fields resulting from equally phased and weighted signals.

The half-loop antenna system 200 may be formed on a printed circuit board with the connector portions being coupled together by via connectors as discussed above with reference to FIG. 1B. When a transmission signal having is applied to both connectors 226 and 228 with equal phase and equal amplitude, the radiation field will extend bi-directionally across the plane of the loop in two elipto-spherical regions, with nulls existing in the transverse directions (into and out of the page). FIG. 7, for example, shows the antenna system 200 of FIG. 6 when a transmission signal is applied to both connectors 226 and 228 with the same amplitude and without any different in phase ($\phi_1-\phi_2=0$). Two resulting elipo-spherical radiation fields 230, 232 result. These fields would also look similar from above (looking down from the top of the page). The same radiation field would exist for reception of equal amplitude and phase signals at the connectors 226, 228. The antenna system may provide either transmission of a signal from a transmitter circuit to the connectors 226 and 228 via the signal path 234, or may provide reception of a signal from the connectors 226 and 228 toward the signal path 234.

Figure 8:
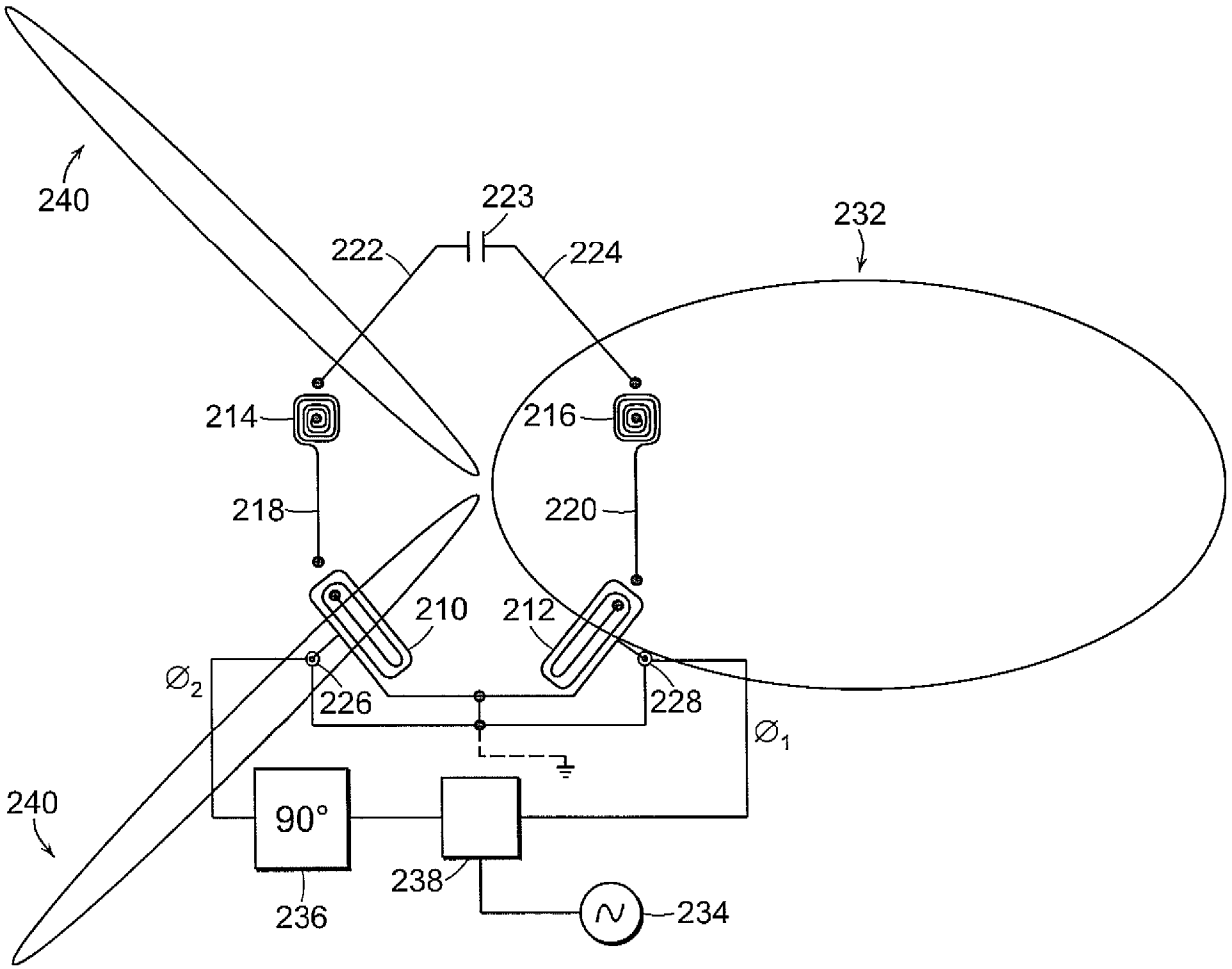
FIG. 8 shows an illustrative diagrammatic view of the antenna system of FIG. 6 with radiation fields resulting from non-equally phased and weighted signals.

As shown, for example, in FIG. 8, if one of the connectors is coupled to a phase shift device 236 that provides, for example, a 90° phase shift, and both paths are coupled to the signal path 234 via a summing amplifier 238, then the resulting radiation fields become shaped as shown at 240 and 242. In accordance with further embodiments two half-loop antenna systems may be joined together such that each has a plane of radiation that is transverse to the other, providing that further beam shaping may be obtained in the transverse direction (in an out of the page) as well.

Figure 9:
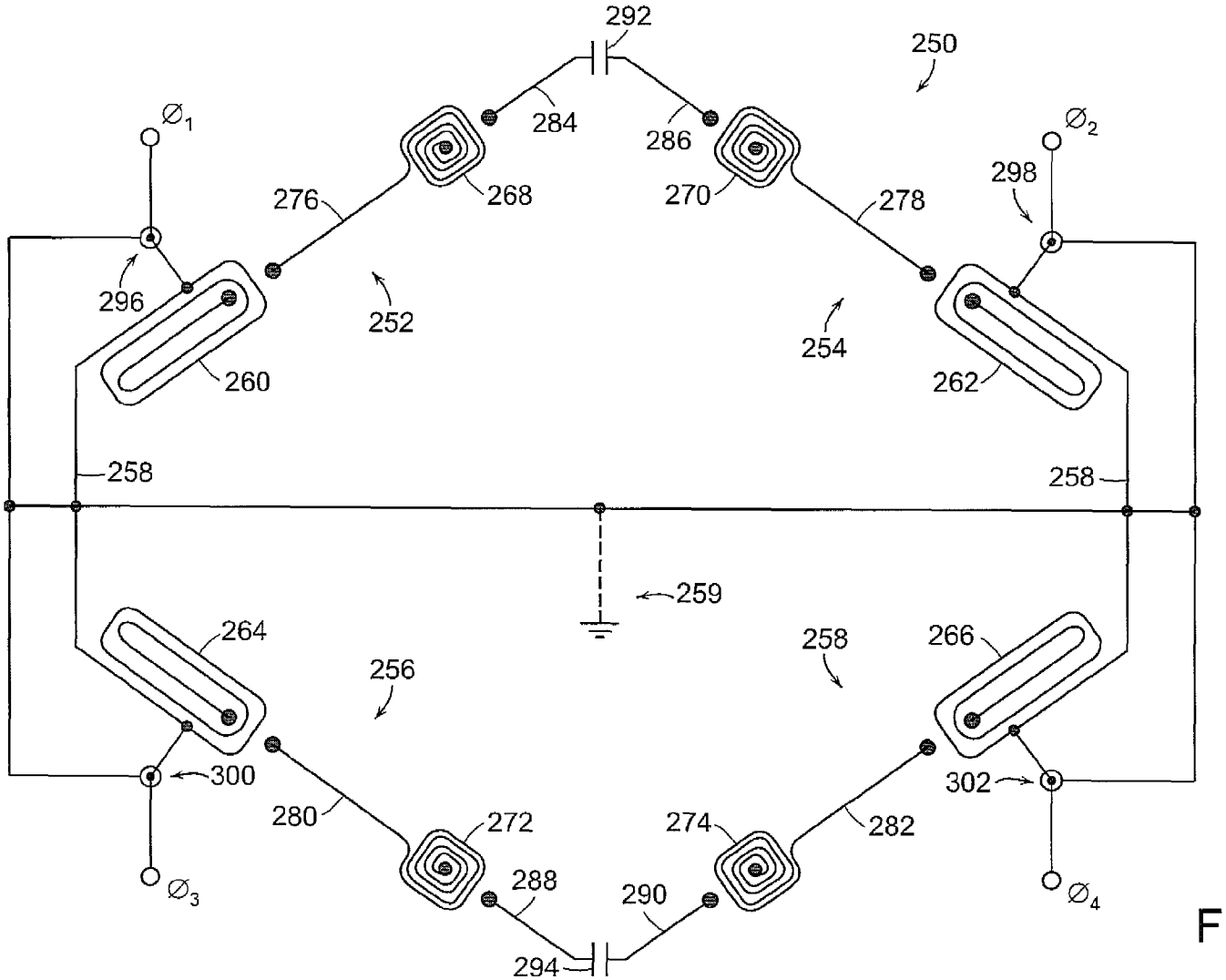
FIG. 9 shows an illustrative diagrammatic view of a full-loop antenna system in accordance with an embodiment of the invention.

Full-loop antenna systems may also be provided as shown at 250 in FIG. 9. The full-loop antenna system 250 includes four distributed load monopole antennas 252, 254, 254 and 256 that are coupled together at their bases 258, and the common bases may optionally be coupled to ground as shown at 259. Each distributed load monopole antenna 252, 254, 256, 258 includes a radiation resistance unit 260, 262, 264 and 266 and a current enhancing unit 262, 270, 272 and 274 that are separated by a conductive mid-section 276, 278, 280 and 282 respectively as shown, as well as top sections 284, 286, 288 and 290. The tops of top sections 284 and 286 are joined by a tuning capacitor 292, and the tops of top sections 288 and 290 are joined by a tuning capacitor 294. Each monopole antenna includes a differential connector such as a 50Ω coaxial feed (296, 298, 300, 302 respectively) that is coupled with one lead to a coupling point on a respective radiation resistance unit (260, 262, 264 and 267), and include a second (typically ground) lead that is coupled to the common base. The signal associated with the connector 296 may be at a first phase $\phi_1$ and a first amplitude, the signal associated with the connector 298 may be at a second phase $\phi_2$ and a second amplitude, the signal associated with the connector 300 may be at a third phase $\phi_3$ and a third amplitude, and the signal associated with the connector 302 may be at a fourth phase $\phi_4$ and a fourth amplitude.

Figure 10:
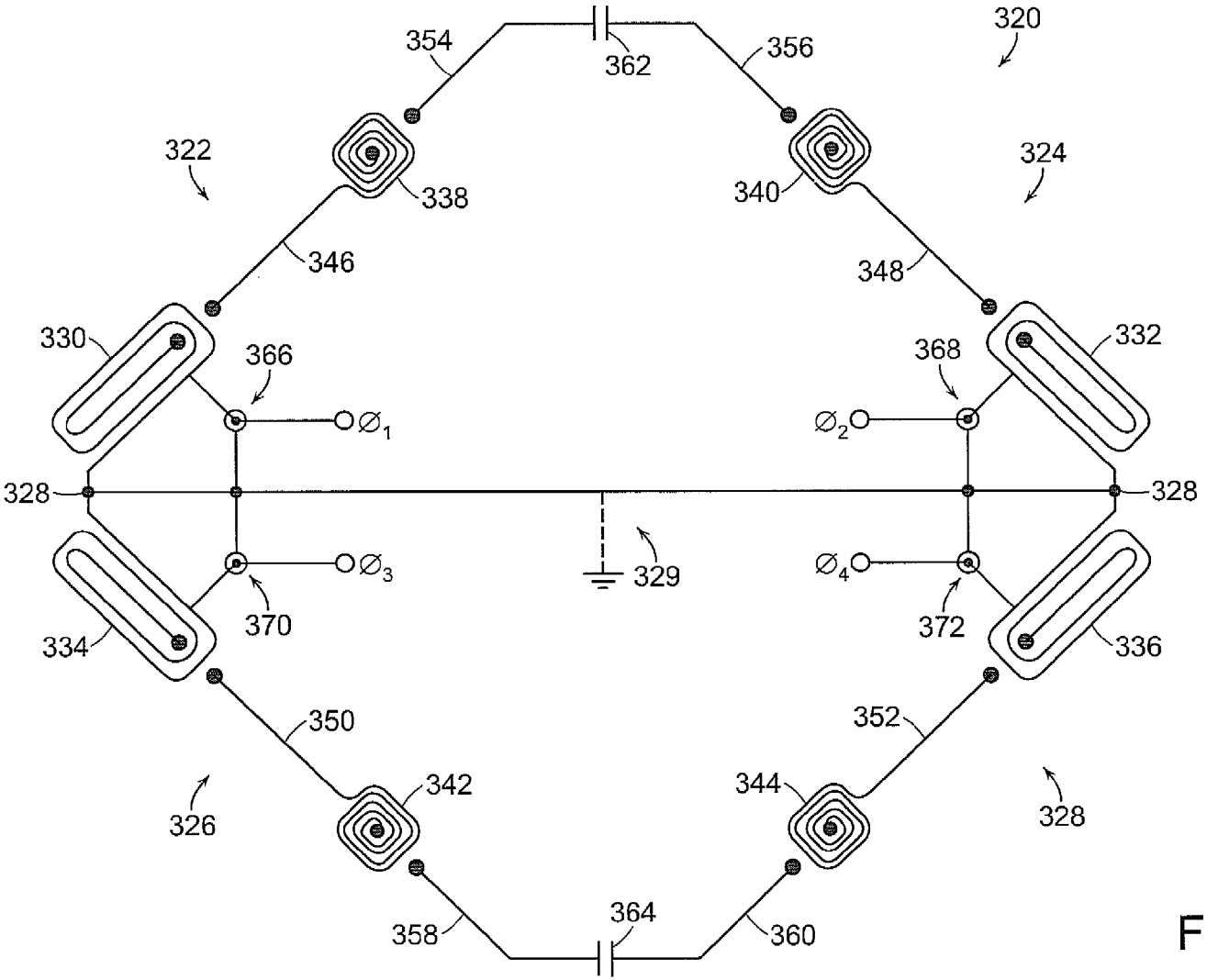
FIG. 10 shows an illustrative diagrammatic view of another full-loop antenna system in accordance with an embodiment of the invention.

FIG. 10 shows at 320 another full-loop antenna system in accordance with an embodiment of the invention in which the direction of wrapping of the radiation resistance units is transposed, permitting connections to be made within the interior of the full-loop. In particular, the full-loop antenna system 320 includes four distributed load monopole antennas 322, 324, 324 and 326 that are coupled together at their bases 328, and the common bases may optionally be coupled to ground as shown at 329. Each distributed load monopole antenna 322, 324, 324 and 326 includes a radiation resistance unit 330, 332, 334 and 336, and a current enhancing unit 338, 340, 342 and 344 that are separated by a conductive mid-section 346, 348, 350 and 352 respectively as shown, as well as top sections 354, 356, 358 and 360. The tops of top sections 354 and 356 are joined by a tuning capacitor 362, and the tops of top sections 358 and 360 are joined by a tuning capacitor 364. Each of the capacitors 362, 364 may be either fixed or adjustable.

Because the element base is at a virtual ground, it may be coupled to ground or any other potential, which permits excellent element isolation, permitting each element to operate independently. This allows tuning of the antenna system to a frequency of resonance by varying the value of capacitors 362 and 364. The impedance of the connectors is, in an embodiment, 50Ω so that it matches most commonly used coaxial connectors.

Each monopole antenna 322, 324, 324 and 326 includes a differential connector such as a 50Ω coaxial feed (366, 368, 370 and 372 respectively) that is coupled with one lead to a coupling point on a respective radiation resistance unit (330, 332, 334 and 336), and includes a second (typically ground) lead that is coupled to the common base. The signal associated with the connector 366 may be at a first phase $\phi_1$ and a first amplitude, the signal associated with the connector 368 may be at a second phase $\phi_2$ and a second amplitude, the signal associated with the connector 370 may be at a third phase $\phi_3$ and a third amplitude, and the signal associated with the connector 372 may be at a fourth phase $\phi_4$ and a fourth amplitude. The control circuit may include, for example, four receivers that are each coupled to a connector 366, 368, 370 and 372, and the receiver outputs of which are each coupled to a receiver output switching network that is coupled to a beam forming circuit such as, for example, an AD8333 DC to 50 MHz, dual I/Q demodulator and phase shifter circuit sold by Analog Devices, Inc. of Norwood, Mass. The full-loop antenna system 320 may operate at, for example, 75 MHz, at which frequency it will measure about six inches by six inches. At twice this frequency (at 150 MHz) the size will reduce to 3 inches by 3 inches. Because the system may be scaled to many further frequencies such as 315 MHz or 433 MHz, the size may become very small.

Figure 11:
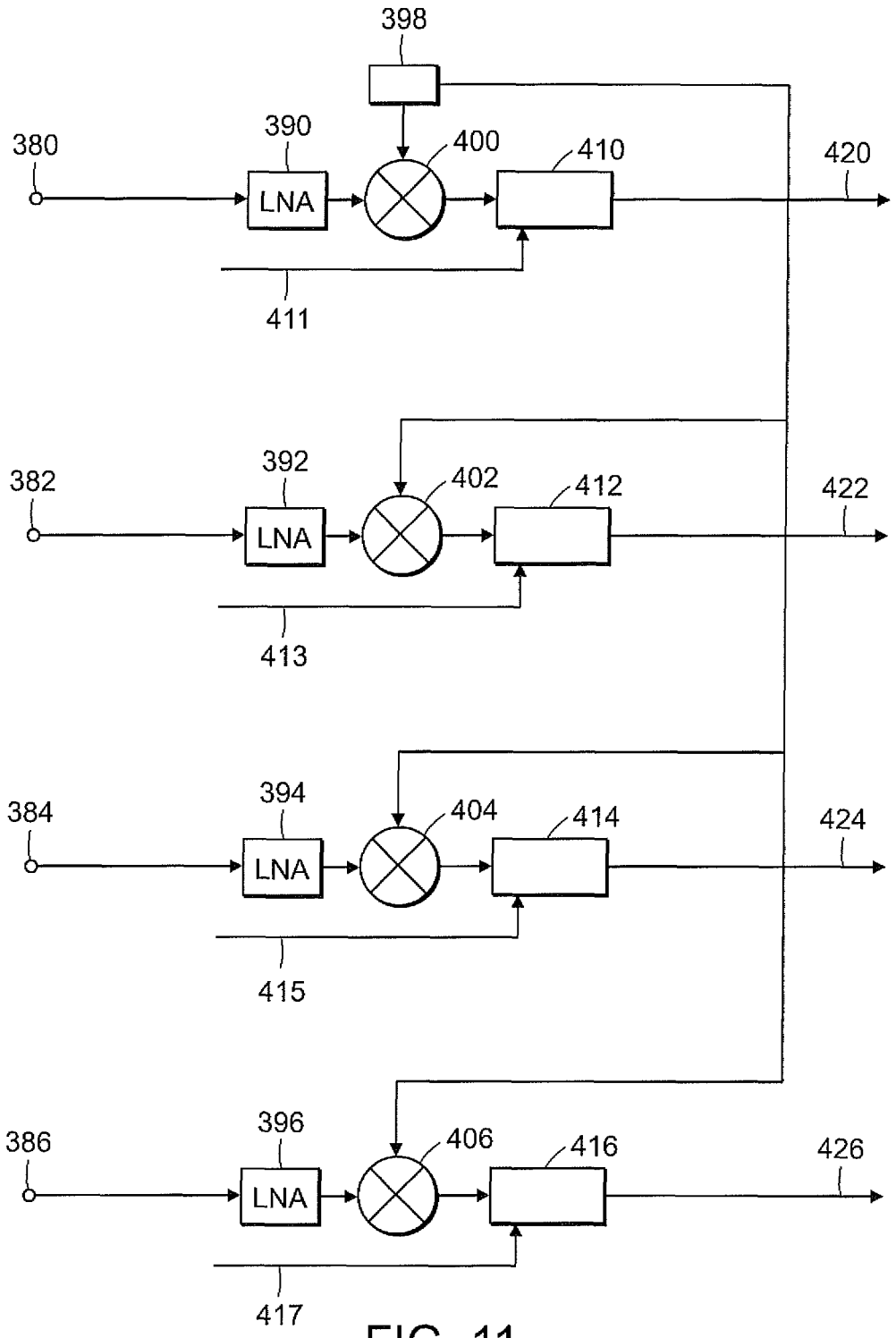
FIG. 11 shows an illustrative diagrammatic view of a control circuit for use in a four channel antenna system in accordance with an embodiment of the invention.

The field shaping may be accomplished using integrated circuits that may perform the beam shaping using programmable phase delays over 360 degrees of phase in 22.5 degree increments. This wide operating frequency permits using a receiver with a down converting mixer and intermediate frequency amplifier to bring each received array signal within the operating range of the beam forming circuit. FIG. 11, for example, shows a control circuit for four channels that receives antenna outputs at 380, 382, 394 and 386, each of which is coupled to a respective low noise amplifier 390, 392, 394 and 396. The outputs of the low noise amplifiers are respectively mixed with a local oscillator signal from a common local oscillator 398 at mixers 400, 402, 404 and 406, and the outputs of the mixers are provided to intermediate frequency (IF) amplifiers with automatic gain control 410, 412, 414 and 416, each of which is coupled to a receiver on/off gate as shown at 411, 413, 415 and 417. The outputs of the amplifiers provide receiver output signals 420, 422, 424 and 426 as shown.

Figure 12:
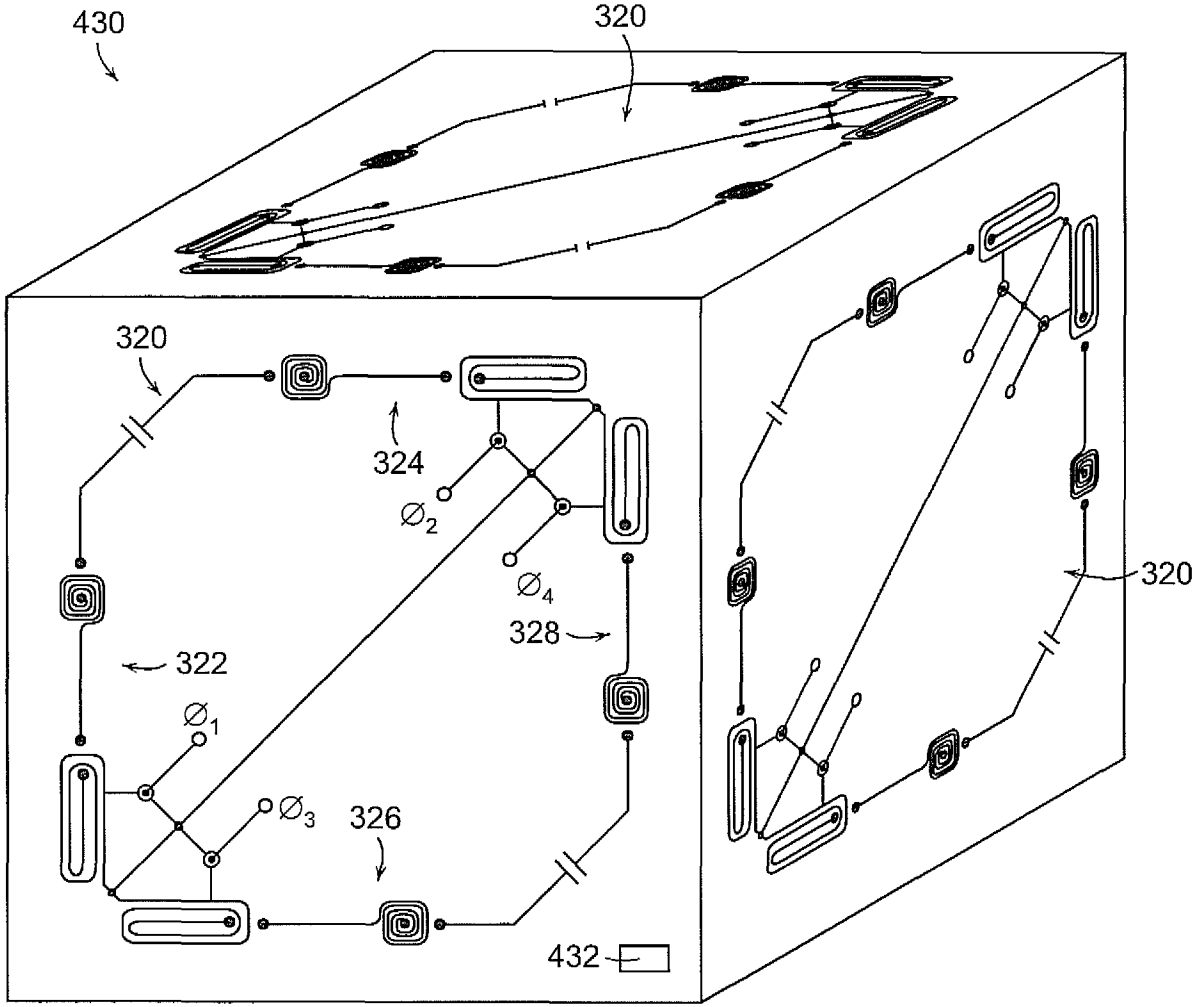
FIG. 12 shows an illustrative diagrammatic view of a cube antenna structure formed of six antenna systems shown in FIG. 10.

The plano-spiral full-loop antenna system 320 of FIG. 10 may be used to form structures such as the antenna cube 430 shown in FIG. 12. In particular, each face of the cube includes an antenna system 320 of FIG. 10. Each connector from each antenna used to form the antenna system may be coupled to a control device outside the cube via a connector port 432. Further complex structures may be formed by combining multiple antenna cubes.

Figure 13:
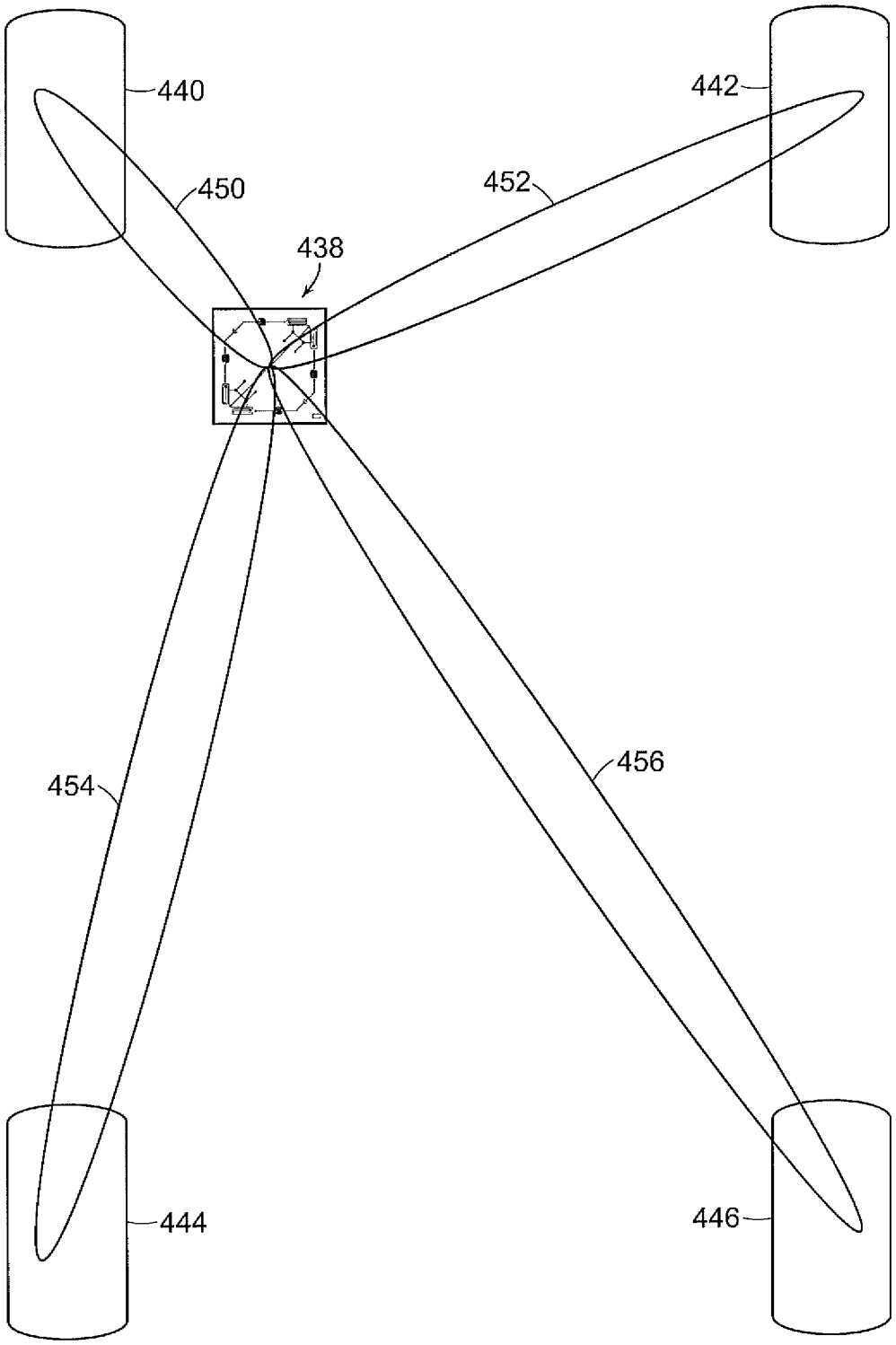
FIG. 13 shows an illustrative diagrammatic view of a tire pressure monitoring system employing a directional antenna system in accordance with an embodiment of the invention.

An antenna system of certain embodiments of the invention, for example, may be employed in a tire monitoring system of an automobile as shown in FIG. 13. An antenna system 438 (such as antenna system 320 or 430) may be used to monitor tire pressure from transmitter devices on each of four tires 440, 442, 444 and 446 of a vehicle. Specific beam shapes may be provides (as shown at 450, 452, 454 and 456) that uniquely address each tire, permitting the antenna system to be positioned anywhere on the vehicle without requiring that the distance between each tire and the antenna system 438 be the same.

Figure 14:
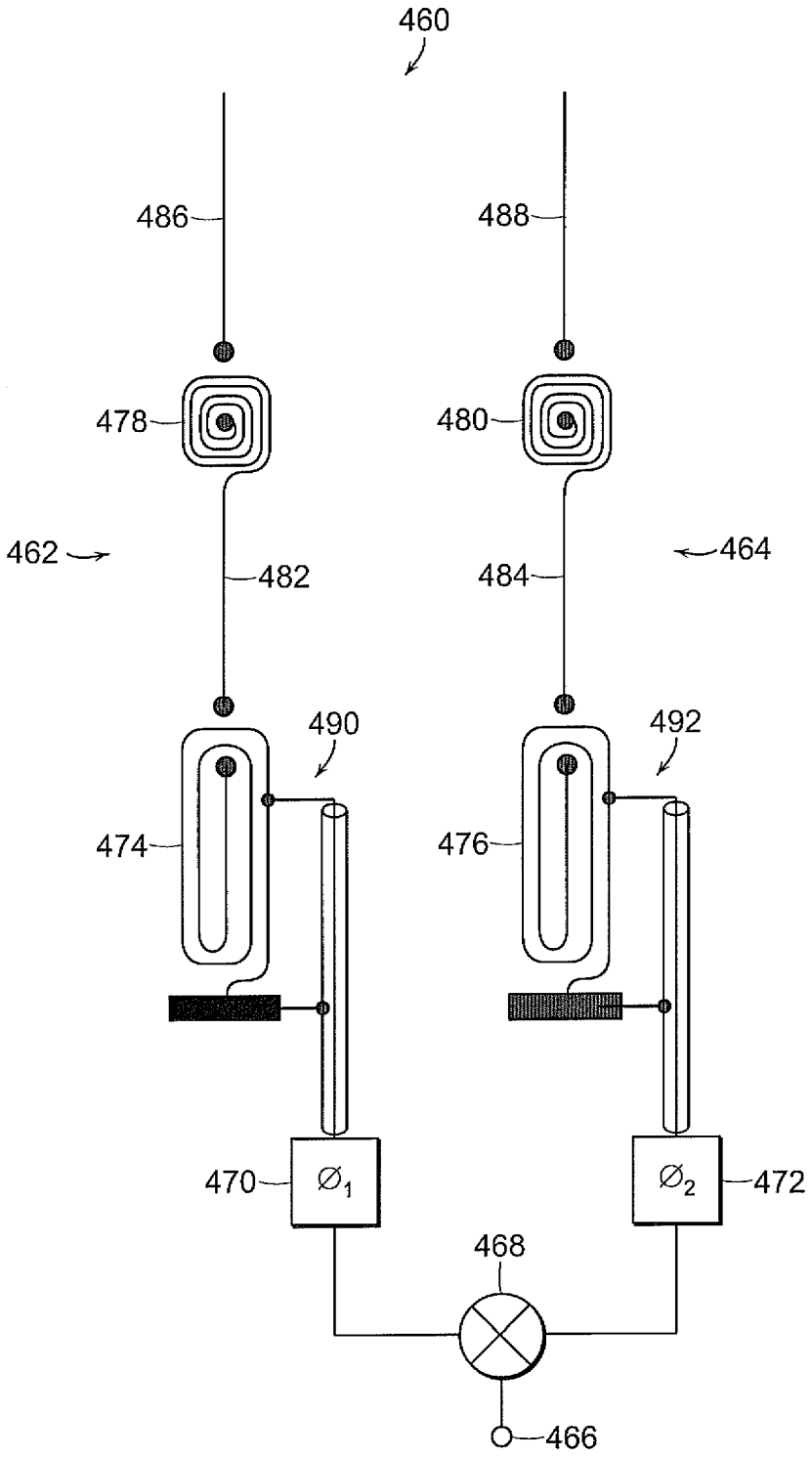
FIG. 14 shows an illustrative diagrammatic view of an antenna system in accordance with a further embodiment of the invention.

An antenna system in accordance with a further embodiment of the invention is shown at 460 in FIG. 14. In the antenna system 460 two distributed load monopole antennas 462, 464 are coupled to a signal path 466 via a combiner amplifier circuit 468 and two phase modulators 470, 472, each of which is coupled to a radiation resistance unit 474, 476 of a respective distributed load monopole antenna 462, 474. Each distributed load monopole antenna 462, 464 also includes a current enhancing unit 478, 480 that is separated from the respective radiation resistance unit by a conductive mid-section 482, 484 respectively as shown, as well as top a section 486, 488. Each monopole antenna includes a differential connector such as a 50Ω coaxial feed (490, 492 respectively) that is coupled with one lead to a coupling point on a respective radiation resistance unit (474 476 respectively), and include a second (typically ground) lead that is coupled to the base.

Figure 15A:
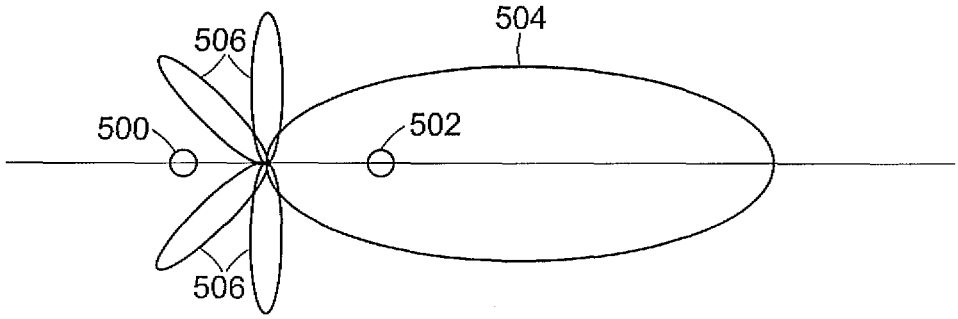
FIGS. 15A-15C show illustrative diagrammatic views of radiation patterns for a two pole antenna system in accordance with an embodiment of the invention.
Figure 15B:
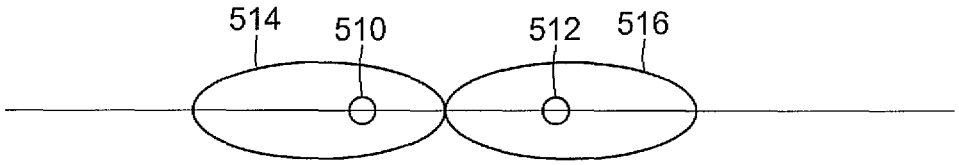
Figure 15C:
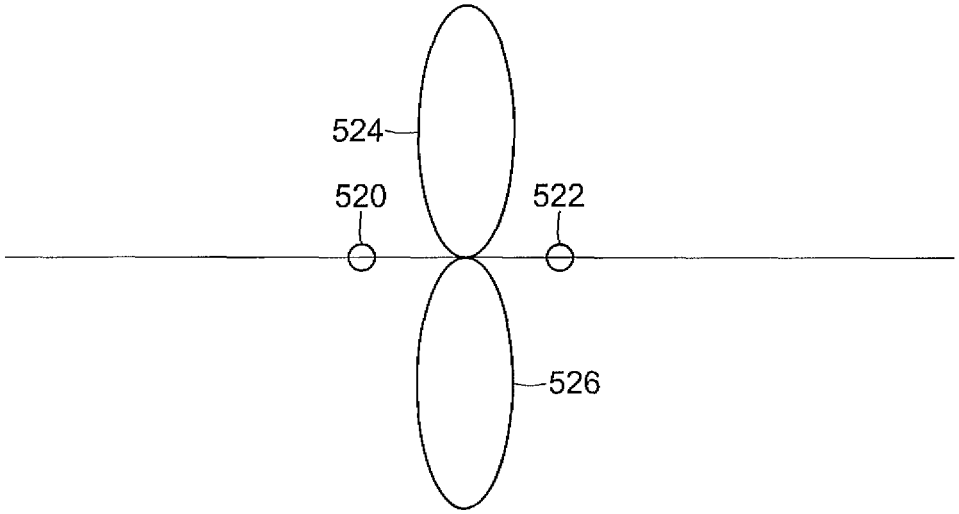

FIGS. 15A-15C show (from above) fields that may result from a two antenna system such as shown in FIG. 13. In particle, FIG. 15A shows a field pattern from two antennas 500, 502 along a plane that results in a field having a primary lobe 504, and several side lobes 506. FIG. 15B shows a field pattern from two antennas 510, 512 along a plane that results in a field having two primary lobes 514 and 516 along the antenna plane. FIG. 15C shows a field pattern from two antennas 520, 522 along a plane that results in a field having two primary lobes 524 and 526 along a plane that is transverse to the antenna plane.

Figure 16:
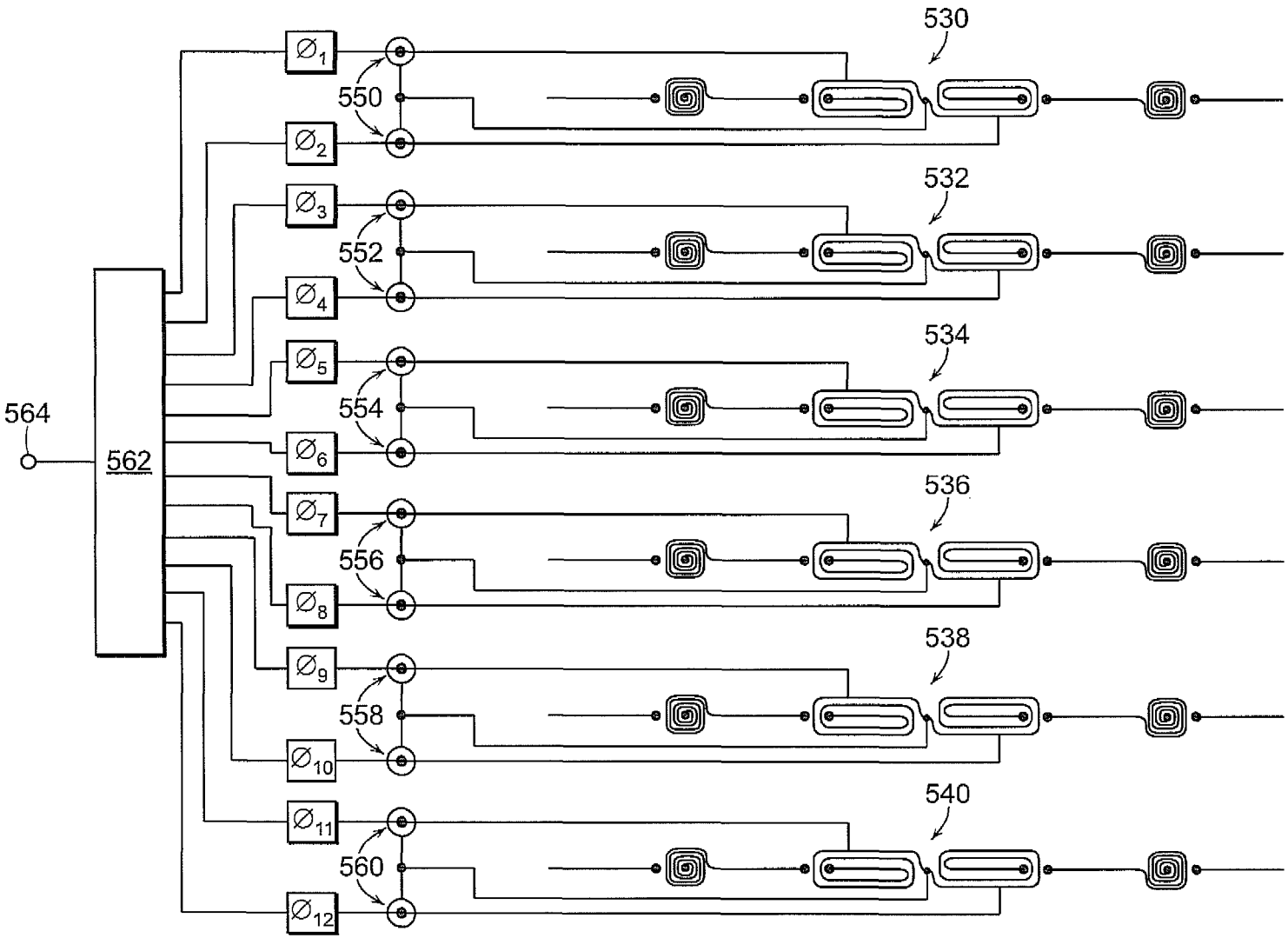
FIG. 16 shows an illustrative diagrammatic view of an antenna system in accordance with a further embodiment of the invention employing six distributed load dipole antennas.

FIG. 16 shows an antenna system that includes 6 distributed load dipole antennas 530, 532, 534, 536, 538 and 540, each of which is formed as discussed above with reference to the distributed load dipole antenna 50 in FIG. 2. The bases of each dipole antenna are coupled together and to a coaxial ground of a respective pair of connectors 550, 552, 554, 556, 558 and 560, with the signal of each connector being coupled to a respective radiation resistance unit as shown. The connector pairs are each coupled to a beam shaper 562, which is also coupled to a signal path 564.

Figure 17A:
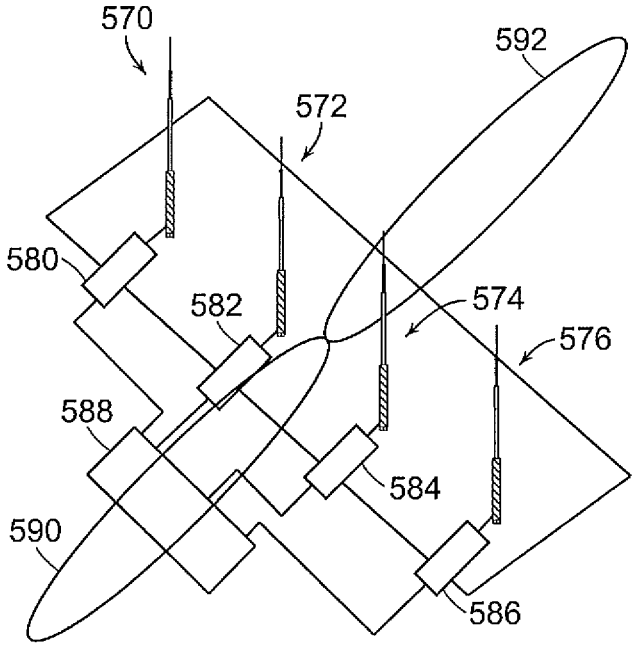
FIGS. 17A and 17B show illustrative diagrammatic views of an antenna system in accordance with a further embodiment of the invention both with equally phased and weighted signals and without equally phased and weighted signals.
Figure 17B:
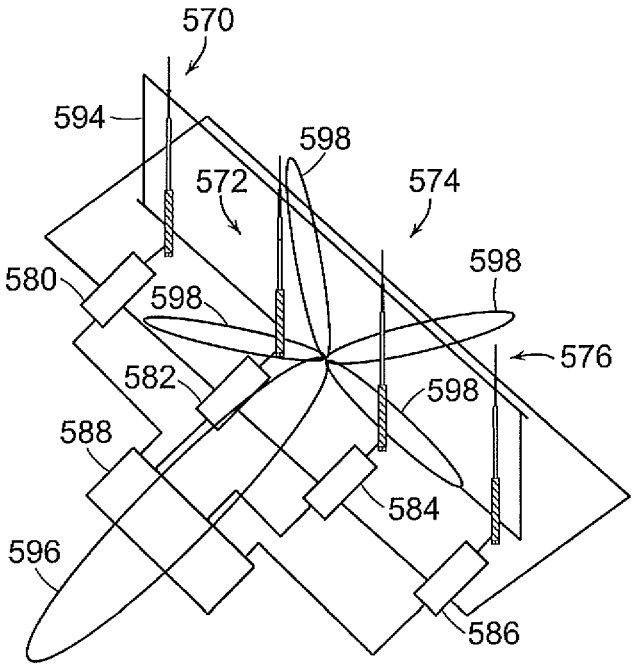

Antenna systems using linear arrays may also be provided using non-planar antennas as shown, for example in FIGS. 17A and 17B. The antenna system includes four distributed load monopole antennas 570, 572, 574 and 576 (each of which may be formed as discussed above with reference to FIG. 1A). The radiation resistance unit of each monopole antenna 570, 572, 574 and 576 is coupled to a receiver 580, 582, 584 and 586, which is in turn coupled to a beam shaper 588. When the phase and amplitude of the signals to each of the antennas 570, 572, 574 and 576 is the same, a radiation field is provided as shown at 590 and 592 in FIG. 17A. When the phase and amplitude are adjusted and when a conductive back-plane 594 is provided on one side of the antennas, the field includes a primary directional lobe 596 and side lobes 598.

Figure 18:
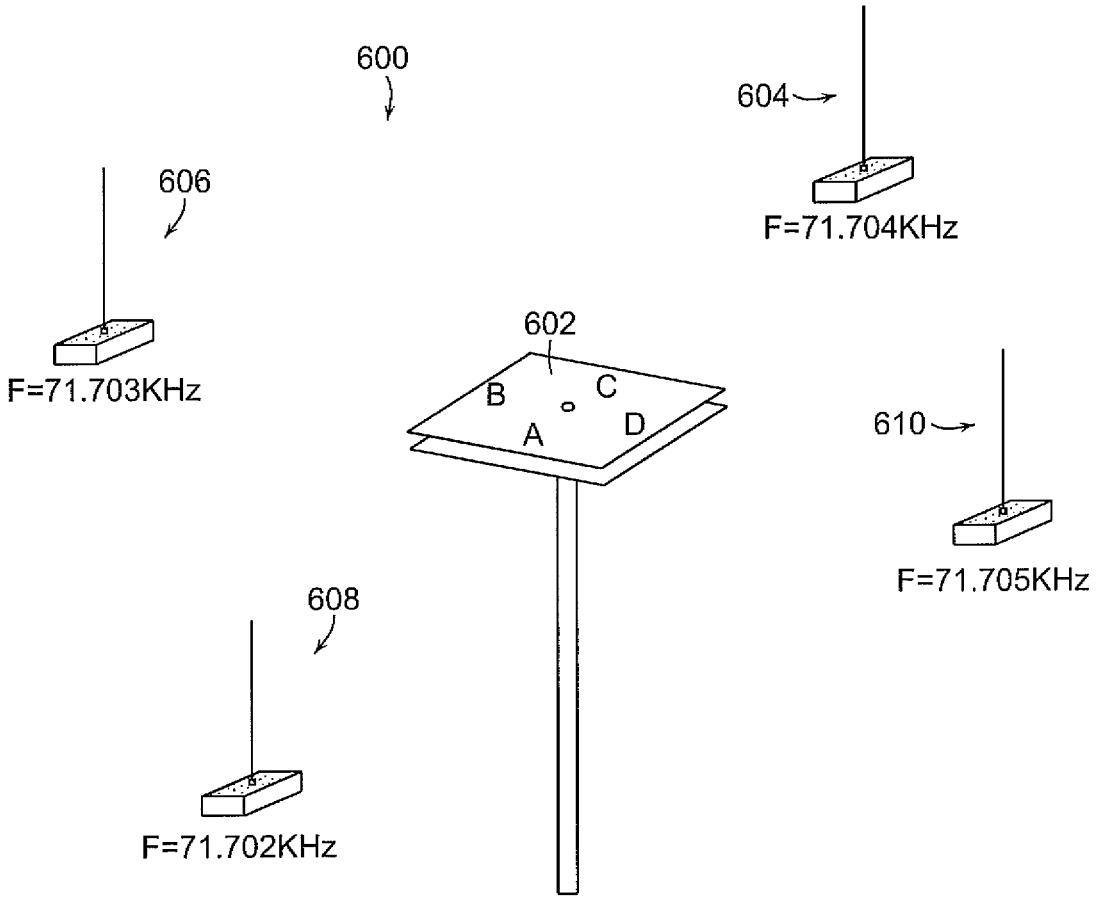
FIG. 18 shows an illustrative diagrammatic view of a test system for facilitating set-up of a system in accordance with an embodiment of the invention.

The tuning of antennas system whether by the use of phasing antenna elements by adjusting spacing or length as well as using electronic beam forming may be facilitated by the use of a signal generation test system 600 as shown in FIG. 18. The system 600 includes a four signal antenna 602 in accordance with an embodiment of the invention, as well as four signal generators 604, 606, 608 and 610 that generate signals at, for example, 71.702 KHz, 71.703 KHz, 71.704 KHz, and 71.705 KHz placed in the quadrants of the antenna response. Antenna performance may be readily observed by measuring the amplitude of the demodulated tones produced in the receiver detector output.

In this example, the array consists of only four elements using four beam formers. To facilitate programming adjustments, the following method may be used to rapidly determine when optimum antenna response has been achieved by either physically adjusting antenna parameters like element spacing and length and/or programming of electronic beam formers.

The antenna under test, whether it be a phased array where phase relationships between antenna elements determines antenna directivity or any other antenna array where physical relationships between antenna elements determines operating performance. To determine the basic four parameters, forward gain, front to back ratio and adjacent front to side ratio the four signals generators or transmitters are utilized. Each signal source is placed into one of each quadrants of the antenna receiving response indicated above.

Figure 19:
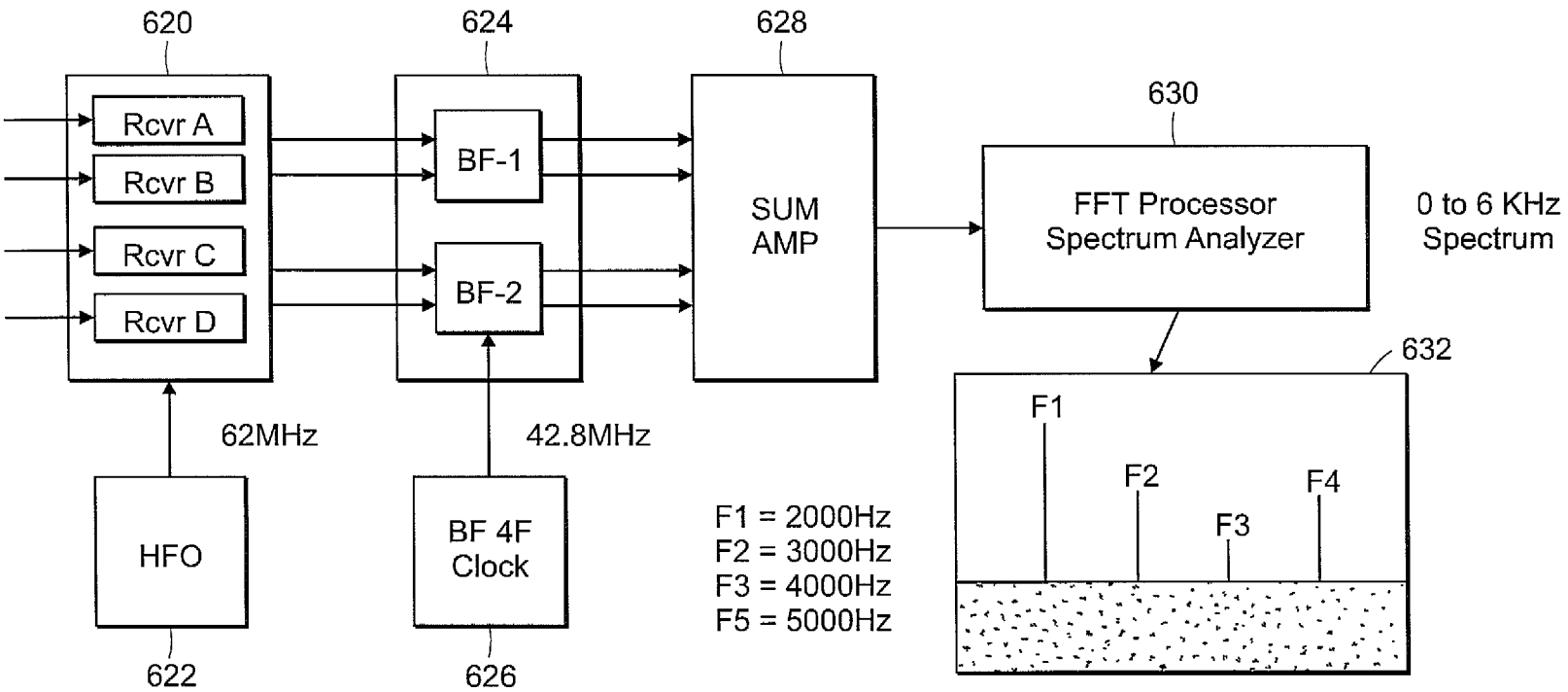
FIG. 19 shows an illustrative diagrammatic view of a circuit for performing set-up testing using the system of FIG. 19.

As shown in FIG. 19, the process operates by observing the audio tones demodulated from any one of a number of transmitters or signal generators modulated with independent and different modulating frequencies (e.g., 2 kHz, 3 kHz, 4 kHz and 5 kHz modulations). Then the receiver demodulated output is displayed on a spectrum analyzer where the amplitude of the various tones can be observed. The tone amplitude observed at the demodulated output is directly related to antenna performance in relationship to forward gain, front to back ratio and front to side ratio. These are the main measurements of antenna directivity performance.

Adjustments of the antenna under test are made while observing the four demodulated tones on the outputs of the receiver 620 which is coupled to a high frequency oscillator 622. The outputs of the receiver are provided to band frequency unit 624 that also receives a clock signal from band frequency clock 626. The outputs of the unit 624 are provided to a summing amplifier 628, which is coupled to a fast Fourier transform spectrum analyzer 630. A possible spectrum output of the analyzer 630 is shown at 632. By adjusting antenna parameters and observing the displayed tones one can rapidly and simultaneously determine how physical adjustment of antenna elements impacts antenna performance for any or all of the desired antenna response directions. This is a much more rapid method then making adjustments and then either rotating the antenna structure or moving around the antenna structure the signal source to determine the response pattern. The adjustment system may be applied to any antenna array. Also there is no limit to the number of transmitters or signal generators than be utilized as long as they demodulate to different audio tones indicative of any number of different antenna response directions.

Those skilled in the art will appreciate that numerous modifications and variations may be made to the above disclosed embodiments without departing from the spirit and scope of the invention.

What is claimed is:

1. An antenna system that provides a directional radiation field, said antenna system comprising at least four monopole antennas, each of which provides a differential connector and each of which includes a transmitter base wherein said transmitter base of each monopole antenna is commonly coupled to a base node, each said monopole antenna including a radiation resistance unit coupled to the transmitter base, a current enhancing unit for enhancing current through said radiation resistance unit, and a conductive mid-section intermediate said radiation resistance unit, wherein each differential connector is provided with a signal having a different phase and a different amplitude such that a radiation field associated with said antenna system is other than a radiation field that would exist if each differential connector were associated with the signal having the same phase and amplitude, and wherein said at least four monopole antennas are separated from one another by a distance of less than $\frac{1}{2}\lambda$ where $\lambda$ is a wavelength of the directional radiation field, wherein said at least four monopole antennas are provided as a full loop antenna array, and wherein each of said at least four monopole antennas include a top section that is coupled to a top section of another of the at least four monopole antennas by a tuning capacitor, said coupled top sections and said commonly coupled transmitter bases of the at least four monopole antennas forming the full loop antenna array.

2. The antenna system as claimed in claim 1, wherein the base of each monopole antenna is coupled to ground.

3. The antenna system as claimed in claim 1, wherein said monopole antennas are provided as planar antennas.

4. The antenna system as claimed in claim 1, where said monopole antennas are provided as a dipole antenna system.

5. The antenna system as claimed in claim 1, wherein said monopole antennas are provided as a structure formed of sides of planar antenna systems, each of which includes a plurality of monopole antennas that are planar.

6. The antenna system as claimed in claim 1, wherein said monopole antennas are provided as an array of monopole antennas.

7. The antenna system as claimed in claim 1, wherein said antenna system is a transmission system and the directional radiation field is a transmission field.

8. The antenna system as claimed in claim 1, wherein said antenna system is a receiver system and the directional radiation field is a reception field.

* * * * *